US008545065B2

(12) United States Patent
Kim et al.

(10) Patent No.: US 8,545,065 B2
(45) Date of Patent: Oct. 1, 2013

(54) LIGHTING APPARATUS

(75) Inventors: Kyunghyun Kim, Seoul (KR); Yonseog Jeon, Seoul (KR); Jongkyo Jeong, Seoul (KR); Kyungnam Park, Seoul (KR); Hongseok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 137 days.

(21) Appl. No.: 13/229,027

(22) Filed: Sep. 9, 2011

(65) Prior Publication Data

US 2012/0300480 A1 Nov. 29, 2012

(30) Foreign Application Priority Data

May 23, 2011 (KR) ..... 10-2011-0048426

(51) Int. Cl.
*F21S 8/08* (2006.01)
*F21V 19/02* (2006.01)

(52) U.S. Cl.
USPC ..... 362/418; 362/431; 362/294

(58) Field of Classification Search
USPC ..... 362/414, 418, 431, 294
See application file for complete search history.

(56) References Cited

U.S. PATENT DOCUMENTS 3,142,501 A * 7/1964 Clark et al. ..... 285/184
3,387,866 A * 6/1968 Baldwin ..... 285/184
4,426,676 A * 1/1984 Taylor ..... 362/371
6,419,378 B1 * 7/2002 Wedell et al. ..... 362/431
7,278,761 B2 * 10/2007 Kuan ..... 362/294
7,828,463 B1 * 11/2010 Willis ..... 362/276
8,021,026 B2 * 9/2011 Liu et al. ..... 362/419
8,277,080 B2 * 10/2012 Duffy et al. ..... 362/249.02

FOREIGN PATENT DOCUMENTS

KR 20-1998-03005 8/1998
KR 10-2010-0100473 9/2010
KR 10-1014165 2/2011
KR 10-1016923 2/2011

* cited by examiner

*Primary Examiner* — Peggy A. Neils
(74) *Attorney, Agent, or Firm* — KED & Associates, LLP

(57) ABSTRACT

A lighting apparatus may include a body having a light emitting module with a light emitting diode (LED), a support member to support the body at a plurality of different tilt positions relative to the support member, and a connection member provided to the body to connect the body to the support member. The connection member may include a first projection that extends to a first height and a second projection that extends to a second height. The body may be provided in a first tilt position relative to the support member when the first projection contacts the end portion of the support member without the second projection contacting the support member, and the body is provided in a second tilt position relative to the support member when the second projection contacts the end portion of the support member.

19 Claims, 10 Drawing Sheets

LIGHTING APPARATUS

CROSS-REFERENCE TO RELATED APPLICATION

This application claims priority under 35 U.S.C. §119 from Korean Application No. 10-2011-0048426 filed May 23, 2011, the subject matter of which is incorporated herein by reference.

BACKGROUND

1. Field

Embodiments may relate to a lighting apparatus.

2. Background

Incandescent lamps, discharge lamps, and fluorescent lamps may be used for lighting in various purposes such as domestic, landscape and/or industrial purposes.

Resistant light sources, such as the incandescent lamps, may have problems of poor efficiency and substantial heat generation. Discharge lamps may have problems of a high price and a high voltage. Fluorescent lamps may have an environmental problem caused by mercury.

A light emitting diode (LED) may have advantages in efficiency, variety of colors, autonomy of design, etc.

The light emitting diode is a semiconductor device that emits a light when a voltage is applied thereto in a forward direction. The light emitting diode may have a long lifetime, a low power consumption, and electric, optical and physical characteristics suitable for mass production, to rapidly replace incandescent lamps and fluorescent lamps. The light emitting diode may be applied to lighting apparatuses, such as street lamps, security lamps and/or park lamps.

The lighting apparatus may be hung from a pole member. The lighting apparatus may direct a light at an optimum angle based on an environment.

A lighting apparatus, such as the street lamp, may be installed at a site after being produced in a state of a tilting angle thereof with respect to a road surface (or an installation surface). The tilting angle of the lamp with respect to the road surface (or the installation surface) may not be adjustable at a time of actual installation.

If the street lamp is installed incorrectly, the light may fail to have a correct angle with respect to the road surface (or the installation surface), light may be directed to an unnecessary region, and/or brightness of a region that requires illumination may become poor.

BRIEF DESCRIPTION OF THE DRAWINGS

Arrangements and/or embodiments may be described in detail with reference to the following drawings in which like reference numerals refer to like elements and wherein.

DETAILED DESCRIPTION

Reference may now be made in detail to specific embodiments, examples of which may be illustrated in the accompanying drawings.

Same reference numbers may be used throughout the drawings to refer to same or like parts, repetitive description may be omitted, and a size and/or a shape may be exaggerated, and/or reduced for ease of description.

Although terms (including ordinal numbers such as first or second) may be used for describing various elements, the elements are not limited by the terms, and may be used only for making one element distinctive from other elements.

Figure 1A:
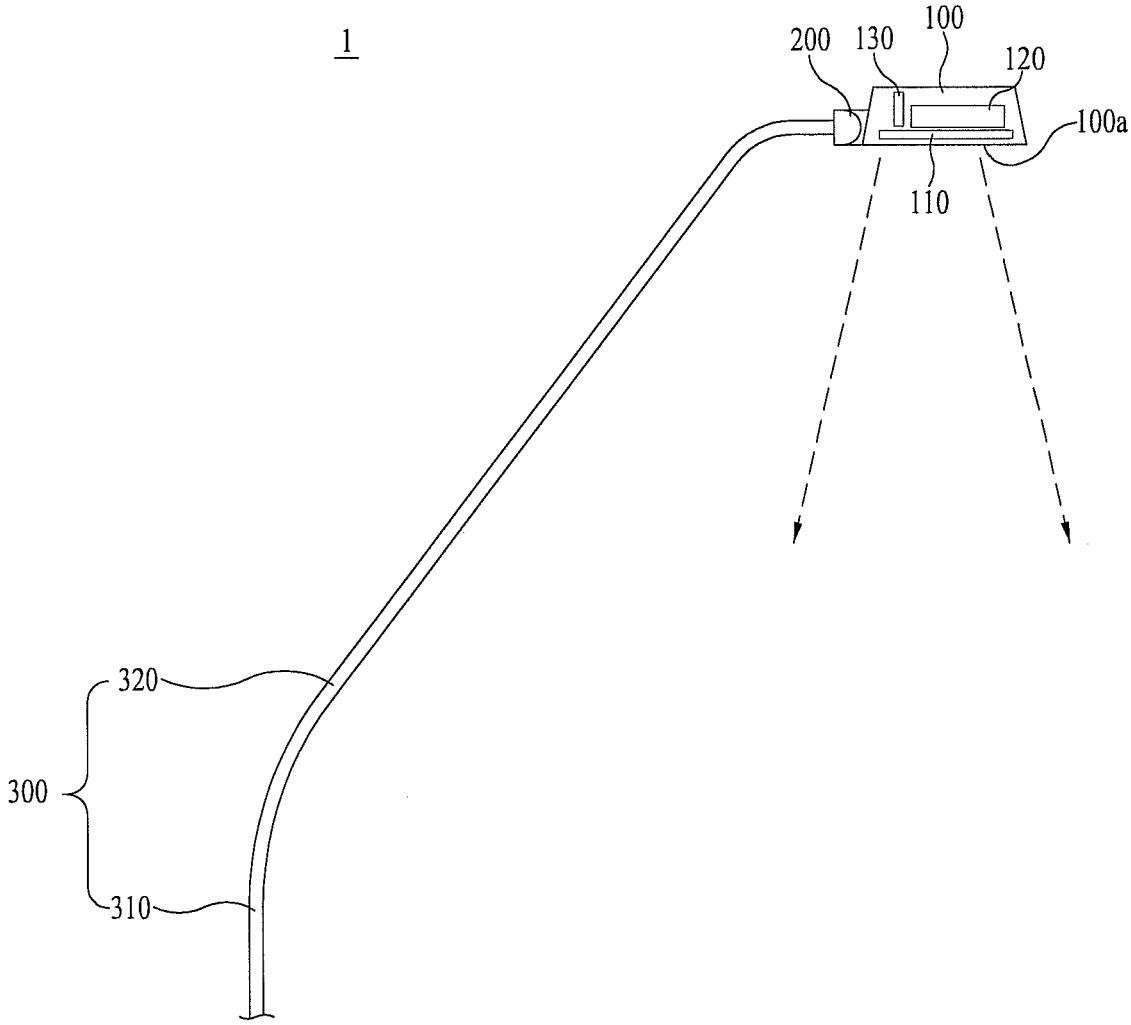
FIGS. 1A and 1B illustrate schematic views of a lighting apparatus in accordance with an embodiment.
Figure 1B:
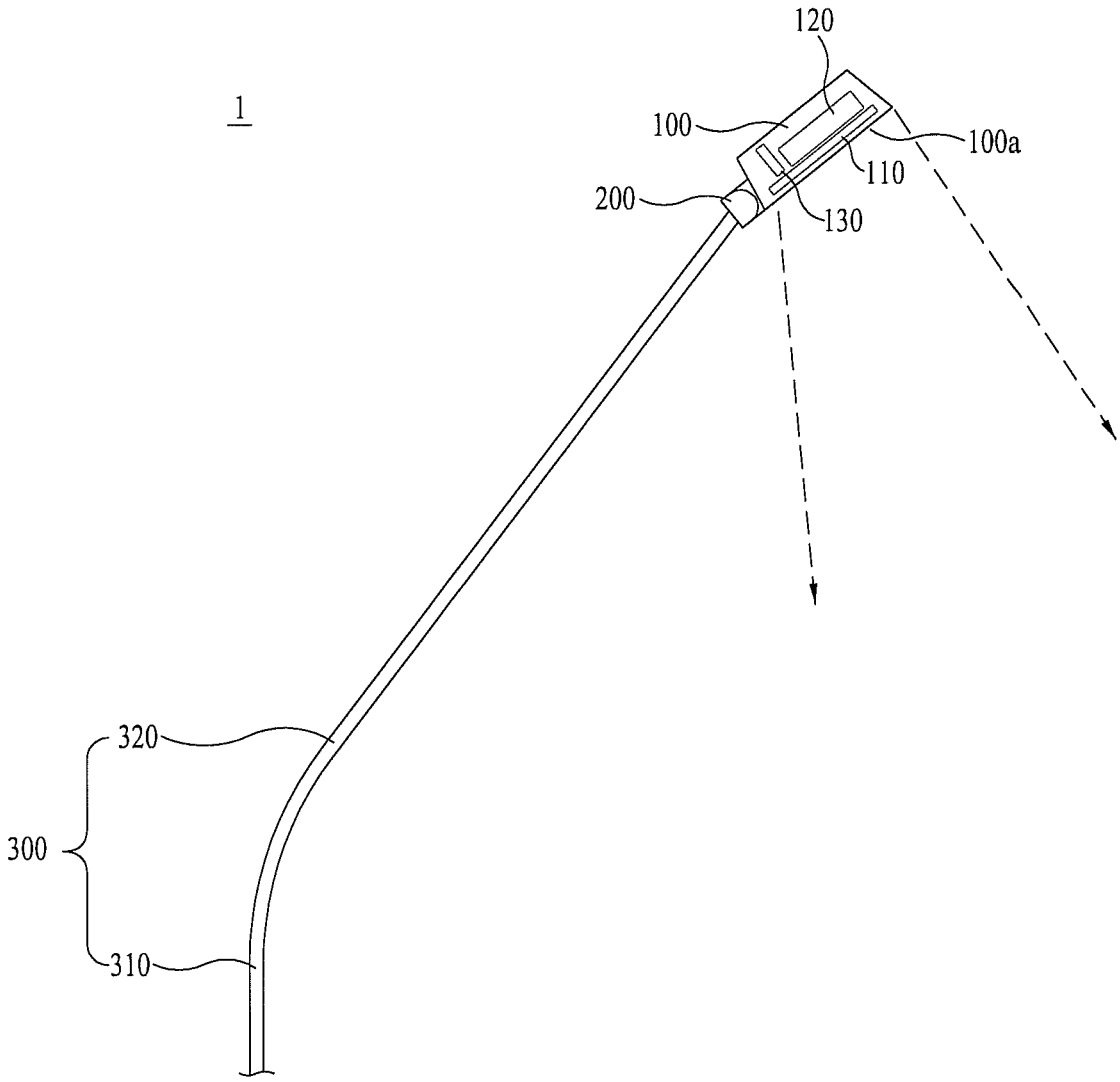
Figure 2:
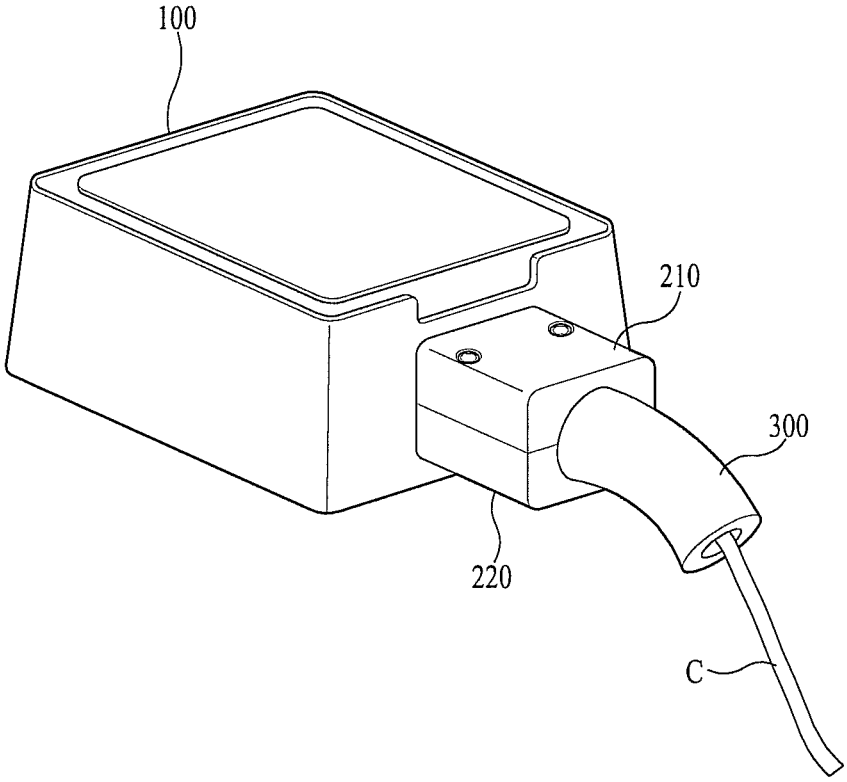
FIG. 2 illustrates a view of a lighting apparatus in accordance with an embodiment.
Figure 3:
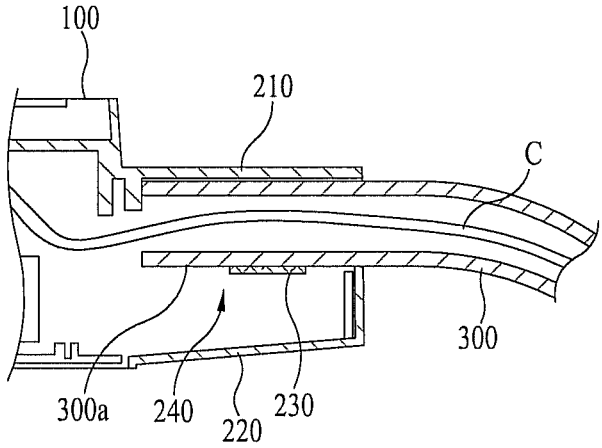
FIG. 3 illustrates parts of the lighting apparatus in FIG. 2.

FIGS. 1A and 1B illustrate schematic views of lighting apparatuses in accordance with an embodiment. FIG. 2 illustrates a view of a lighting apparatus in accordance with an embodiment. FIG. 3 illustrates parts of the lighting apparatus in FIG. 2.

Figure 4:
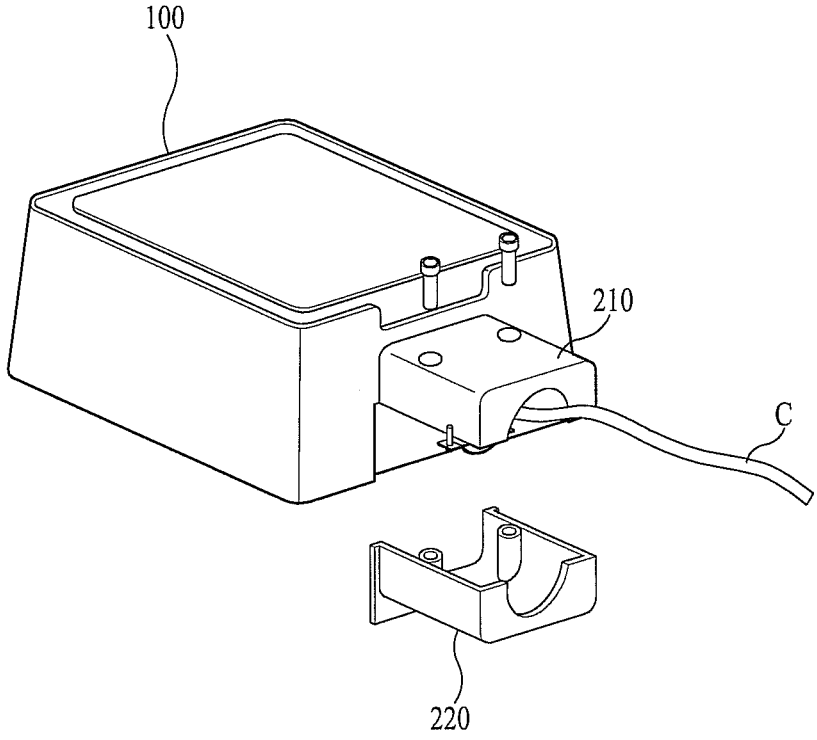
FIG. 4 illustrates an exploded view of the lighting apparatus in FIG. 2.
Figure 5:
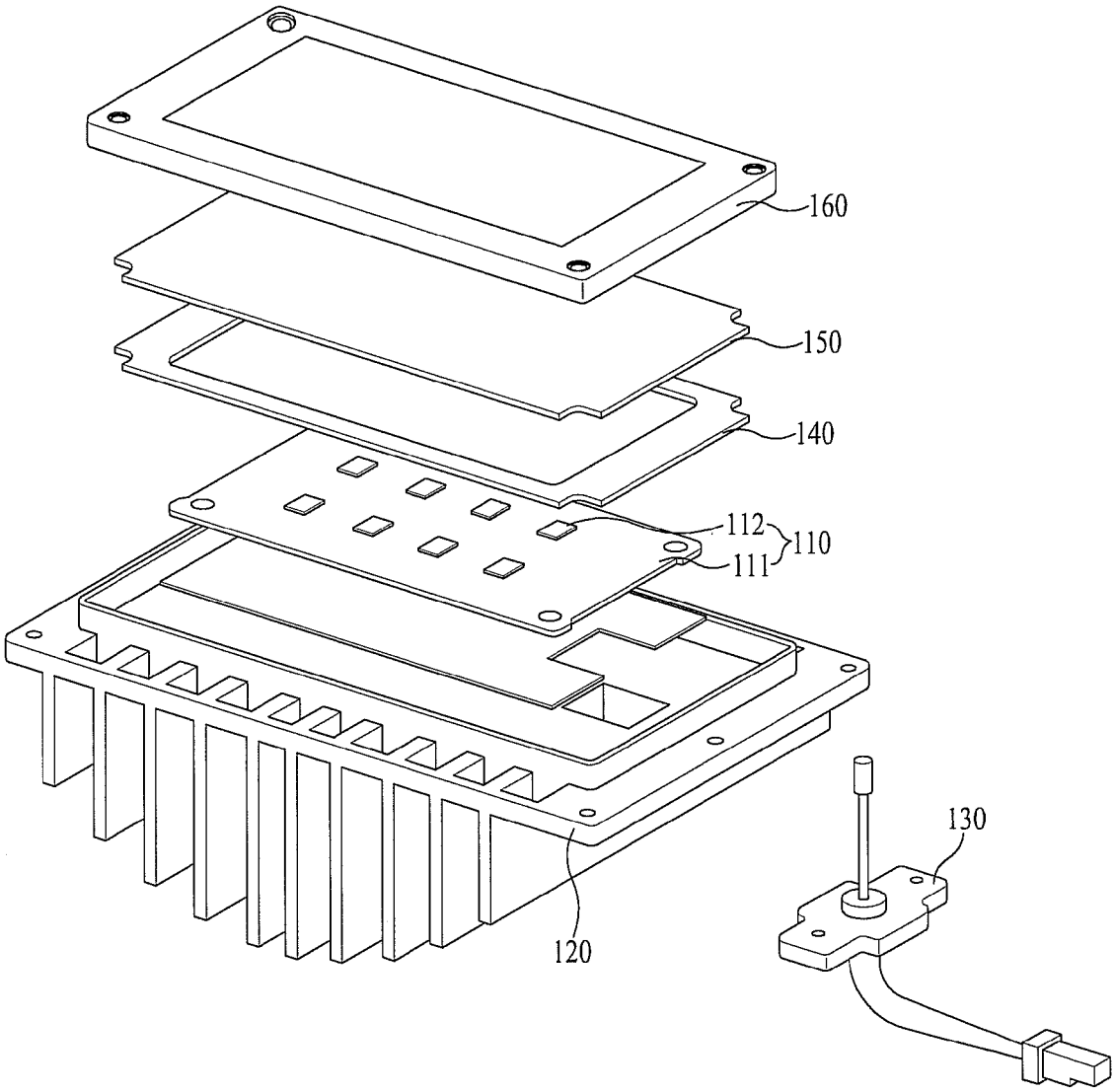
FIG. 5 illustrates an exploded view of a body of a lighting apparatus in accordance with an embodiment.
Figure 6:
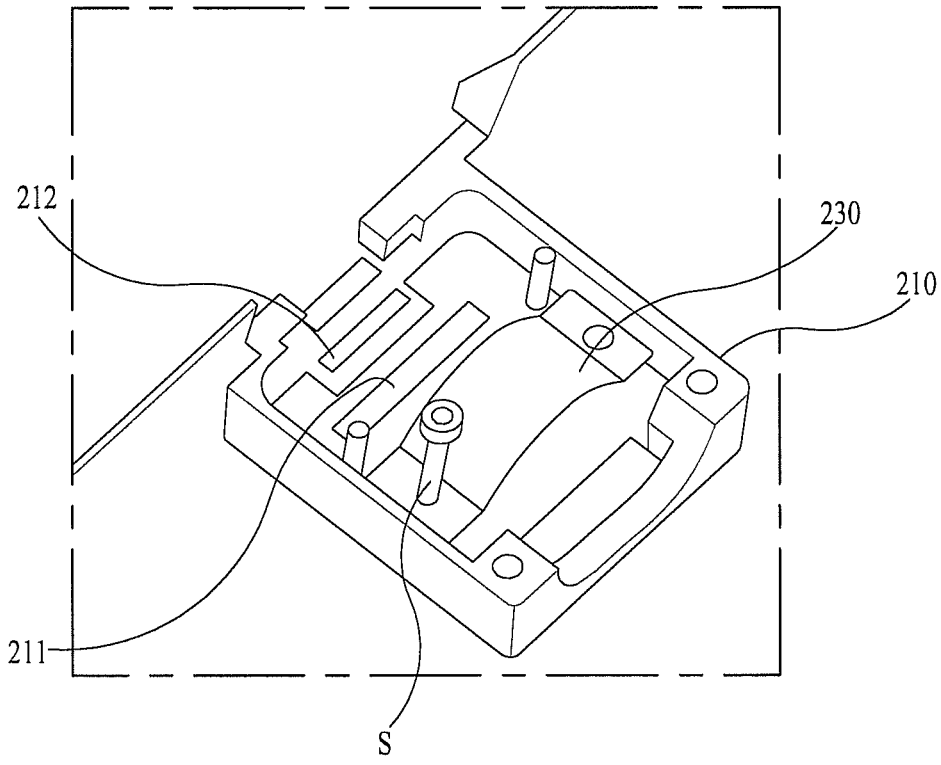
FIG. 6 illustrates parts of a lighting apparatus in accordance with an embodiment.
Figure 7:
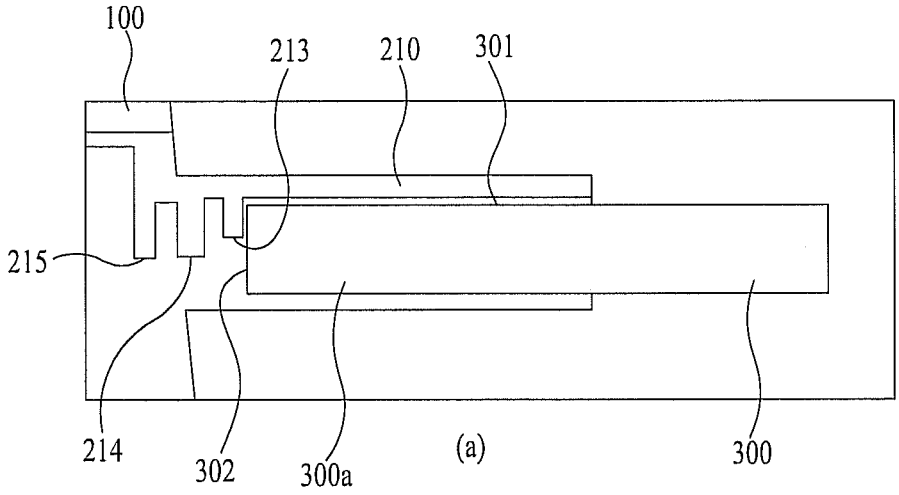
FIG. 7 illustrates a tilt adjust portion of a lighting apparatus in accordance with an embodiment.
Figure 7:
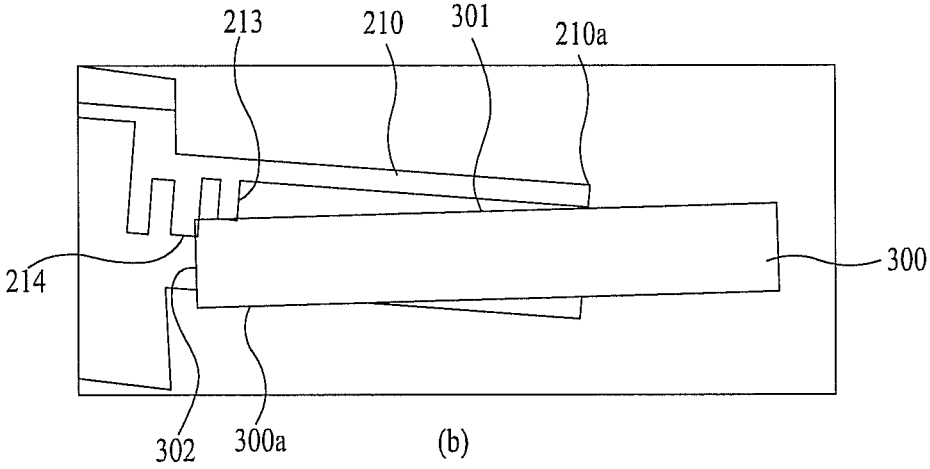
Figure 8:
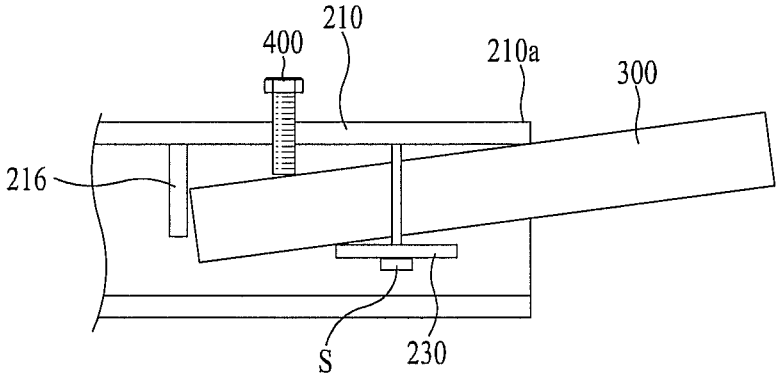
FIG. 8 illustrates a tilt adjust portion of a lighting apparatus in accordance with an embodiment.
Figure 9:
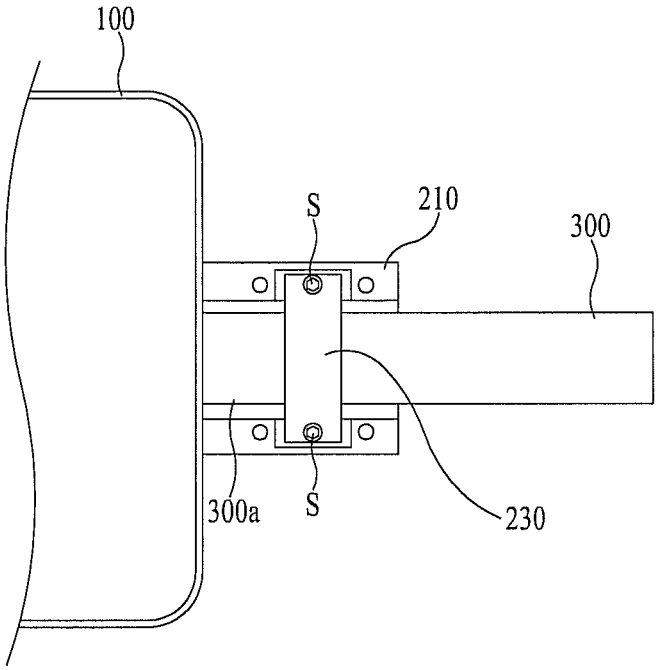
FIG. 9 illustrates parts of a lighting apparatus in accordance with an embodiment.
Figure 10:
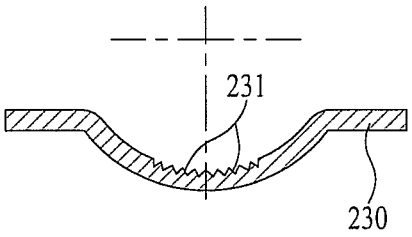
FIG. 10 illustrates a middle cover of a lighting apparatus in accordance with an embodiment.

FIG. 4 illustrates an exploded view of the lighting apparatus in FIG. 2. FIG. 5 illustrates an exploded view of a body of a lighting apparatus in accordance with an embodiment. FIG. 6 illustrates parts of a lighting apparatus in accordance with an embodiment. FIG. 7 illustrates a tilt adjust portion of a lighting apparatus in accordance with an embodiment. FIG. 8 illustrates a tilt adjust portion of a lighting apparatus in accordance with an embodiment. FIG. 9 illustrates parts of a lighting apparatus in accordance with an embodiment. FIG. 10 illustrates a middle cover of a lighting apparatus in accordance with an embodiment. Other embodiments and configurations may also be provided.

A lighting apparatus 1 may include all lighting apparatuses, such as a street lighting apparatus. For ease of description, the following descriptions may be provided with respect to a street lighting apparatus.

The lighting apparatus 1 may include a body 100 for directing a light to a lighting space, a connection member 200 provided at a longitudinal end portion of the body 100, and a support member 300 for connecting to the connection member 200 and providing the connection member 200 (or the body 100) at a predetermined tilt angle with respect to the support member 300. The connection member 200 and the support member 300 may adjust a light directing angle (or light direction position) of the body 100 (relative to the support member 300). This may change a light direction of light.

The body 100 may have a substrate 111, a light emitting module 110 with a light emitting diode (LED) 112 mounted to the substrate 111, and a heat sink 120 to dissipate heat from the light emitting module 110. The connection member 200 may be provided to the body 100 for connecting the body 100 to the support member 300, and to be provided an ability to change a tilt angle of the body 100 relative to the support member 300. The connection member 200 may be formed with the body 100 as one unit.

Referring to FIGS. 1A and 1B, the body 100 and the connection member 200 may be mounted to the support unit 300 at one of a plurality of tilt angles (or tilt positions). For example, the body 100 and the connection member 200 may be mounted at an angle of 0° with respect to a road surface (or an installation surface that is substantially parallel thereto), or may be mounted at an angle of 5°~8° with respect to a road surface (or the installation surface).

The support member 300 may have a pole portion 310 and an arm portion 320. The pole portion 310 and the arm portion 320 may have a variety of different shapes and/or sizes based on specialty and design characteristics of the installation space. The support member 300 may only have the pole portion 310 (without the arm portion). The support member 300 may include an end portion 300*a*

By arranging the end portion 300*a* of the support member 300 at a predetermined angle with respect to the connection member 200, the connection member 200 and the support member 300 may be assembled at a predetermined tilt angle while at an installation site.

Referring to FIG. 5, the body 100 may include a power supply unit 130 to electrically connect to the light emitting module 110. A cable C may electrically connect the power supply unit 130 to an external power source. The cable C may be provided in the support member 300 and may pass through the connection member 200.

The heat sink 120 may dissipate heat from the LED (and/or light emitting module 110) when the LED is turned on. The heat sink 120 may be formed of a metal having a high heat conductivity, and the heat sink 120 may have heat dissipating fins for increasing a heat dissipating area. The power supply unit 130 may include a converter for converting external power, and for supplying the same to the light emitting module 110.

The body 100 may include a lens or a diffusing member 150 provided in front of the light emitting module 110, a frame 140 provided between the lens or the diffusing member 150 and the substrate 111 to maintain a predetermined gap therebetween, and a cover 160 for surrounding a periphery of the lens or the diffusing member 150.

The cover 160 and the lens or the diffusing member 150 may form a light emission face 100*a* of the body 100 as shown in FIG. 1. The cover 160 may have a longitudinal end portion rotatably mounted to the body 100, to selectively open/close an inside of the body 100 for inspection of the light emitting module 110.

A tilt adjust portion of the connection member 200 may include a plurality of seating portions 211 and 213. The seating portions 211, 213 may also be called projections.

Referring to FIGS. 3 and 4, the connection member 200 may include an upper housing 210 having the plurality of seating portions 211 and 212 (or projections), a middle cover 230 fastened to the upper housing 210 for supporting the support member 300, and a lower housing 220 mounted to the upper housing 210 to surround the middle cover 230 and form a predetermined space 240 therein.

The upper housing 210 and the lower housing 220 may form a hollow cylinder after being fastened together.

The upper housing 210 may be formed as one unit with the body 100.

A structure may be provided such that the end portion 300*a* of the support member 300 is provided at a predetermined angle with respect to the connection member 200.

FIG. 6 shows the plurality of seating portions 211 and 212 (or projections) for seating the end portion 300*a* (of the support member 300). The seating portions 211 and 212 (or projections) may be provided on an inner surface (or inner circumference) of the upper housing 210 (of the connection member 200). Two adjacent seating portions 211 and 212 (or projections) may form a step to have a predetermined difference of heights. The seating portions 211, 212 (or projections) may have a height that becomes greater as the seating portions 211, 212 (or projections) get closer to the body 100.

If the end portion 300*a* of the support member 300 is seated on a first seating portion 211 without being seated on the seating portion, the body 100 and the connection member 200 may be mounted to have a predetermined tilt angle (e.g., 5°) with respect to the support member 300.

If the end portion 300*a* of the support member 300 is seated on a second seating portion 212 having a greater height than the first seating portion 211, the body 100 and the connection member 200 may be mounted to have a predetermined tilt angle (e.g., 8°) with respect to the support member 300.

At the time of tilt adjustment of the body 100, the support member 300 may be supported on a free end portion 210*a* of the upper housing 210. The free end portion 210*a* of the upper housing 210 may serve as a rotational support axis at the time of tilt adjustment.

The body 100, the upper housing 210 (of the connection member 200) and the plurality of seating portions 211 and 212 (or projections) may be formed as one unit.

Referring to FIGS. 7A and 7B, the seating portion may include a plurality of projections 213-215 that extend inward from the inner surface (or inner circumference) of the connection member 200. Heights of the projections may be higher as the projection gets closer toward the body 100.

FIG. 7 shows the first projection 213 extending inward from the inner surface of the upper housing 210 and having a first height. FIG. 7 also shows the second projection 214 extending inward from the inner surface of the upper housing 210 and having a second height. FIG. 7 also shows the third projection 215 extending inward from the inner surface of the upper housing 210 and having a third height. The second height of the second projection 214 may be greater than the first height of the first projection 213. Further, the third height of the third projection 215 may be greater than the second height of the second projection 214.

FIGS. 7A-7B show the support member 300 having a first surface 301 and a second surface 302. The first surface 301 may face an inner surface of the connection member 200.

Referring to FIG. 7A, the end portion 300*a* of the support member 300 may be provided in a space within the connection member 200. The body 100 and the connection member 200 may be mounted to have a predetermined tilt angle (e.g. 0°) with respect to the support member 300. In FIG. 7A, the first projection 213 may contact the second surface 302 of the support member 300 without the second projection 214 contacting the first or second surfaces 301, 302.

Referring to FIG. 7B, the end portion 300*a* of the support member 300 may be arranged in a space between two adjacent projections, such as the first projection 213 and the second projection 214. In this example, the body 100 and the connection member 200 may be mounted to have a predetermined tilt angle (e.g., 5°) with respect to the support member 300. In FIG. 7B, the first projection 213 may contact the first surface 301 and the second projection 214 may contact the second surface 302.

At the time of tilt adjustment of the body 100, the support member 300 may be supported on the free end portion 210*a* of the upper housing 210. The free end portion 210*a* (of the upper housing 210) may serve as a rotational support axis at the time of tilt adjustment.

Thus, since only the seating of the end portion 300*a* of the support member 300 on any one of the projections or seating portions 211 to 215 (of the connection member 200) is required for adjustment of the tilt angle of the body 100, assembly of the lighting apparatus 1 may be easy.

By providing a plurality of projections (or seating portions), the lighting apparatus 1 may precisely adjust the tilt angle.

Referring to FIGS. 3 and 6, the middle cover 230 (of the connection member 200) may apply a pressure to a region of the support member 300 to serve a function in which the end portion 300*a* is prevented from falling off any one of the seating portions 211, 212 or the projections 213, 214, 215 (of the connection member 200). The middle cover 230 may attach to the upper housing 210 with a screw S and when the middle cover 230 is spaced from the upper housing 210.

Referring to FIG. 7A, if the end portion 300*a* (of the support member 300) is provided in the space between inner surfaces of the connection member 200, the body 100 and the connection member 200 may be mounted to have a predetermined tilt angle (e.g., 0°) with respect to the support member 300 when the middle cover 230 is fastened with the screw S in a state the middle cover 230 contacts the upper housing 210.

In this example, if the support member 300 is provided in the connection member 200, the first projection 213 may serve as a stopper to prevent or stop the support member 300 from moving (or entering) into the body 100.

As shown in FIG. 7B, if the end portion 300*a* (of the support member 300) is provided in the space between two adjacent projections 213 and 214, the body 100 and the connection member 200 may be mounted to have a predetermined tilt angle (e.g., 5°) with respect to the support member 300, and the middle cover 230 may be fastened with the screw S such that the middle cover 230 is spaced a predetermined distance from the upper housing 210.

In this example, if the support member 300 is provided in the connection member 200 at the predetermined tilt angle, the second projection 214 may serve as a stopper to prevent or stop the support member 300 from entering into (or moving into) the body 100.

At the time of tilt adjustment of the body 100, the support member 300 may be supported on the free end portion 210*a* (of the upper housing 210). The free end portion 210*a* of the upper housing 210 may serve as a rotational support axis at the time of tilt adjustment.

Thus, the support member 300 may be fastened at a predetermined tilt angle (or tilt position) in the connection member 200 by the inner surface (or inner circumference) of the connection member 200 and the first projection 213 or the first and second projections 213 and 214 and the free end portion 210*a* of the upper housing 210 and the middle cover 230.

FIG. 3 shows the space 240 formed between the upper housing 210 and the lower housing 220. The space 240 may have a volume large enough to prevent interference with the end portion 300*a* (of the support member 300) even when the support member 300 is provided at the predetermined tilt angle.

FIG. 8 shows a screw 400 that is movable in/out of the connection member 200 so as to be in contact with the support member 300. A stopper 216 may be provided in the connection member 200 to prevent or stop the support member 300 from further entering into the connection member 200.

In this example, at the time of tilt adjustment of the body 100, the support member 300 may be supported on the free end portion 210*a* of the upper housing 210. The free end portion 210*a* (of the upper housing 210) may serve as a rotational support axis at the time of tilt adjustment.

By rotating the screw 400 in a clockwise direction (or in an anti-clockwise direction), the tilt angle of the support member 300 may be adjusted with respect to the body 100.

The support member 300 may be fastened into the connection member 200 at the predetermined angle by the stopper 216 (of the connection member 200), the free end portion 210*a* (of the upper housing 210), the screw 400 and the middle cover 230.

FIG. 10 shows the middle cover 230 having a plurality of projections 231 from an inner surface for increasing a contact area with the connection member 200.

The lighting apparatus may adjust an angle to suit to the lighting space.

The lighting apparatus may adjust a light distribution so as to be proper to the installation site, to increase light efficiency and/or to save energy.

The lighting apparatus may reduce a number of components, reduce a production cost and/or enhance reliability.

An embodiment may be directed to a lighting apparatus.

An embodiment may provide a lighting apparatus that enables to adjust an angle thereof to suit to a lighting space.

An embodiment may provide a lighting apparatus that enables to adjust a light distribution at an installation site, increase a lighting efficiency, and/or save energy.

An embodiment may provide a lighting apparatus that enables to reduce a number of components and a production cost.

A lighting apparatus may include a body having a substrate, a light emitting module with a plurality of LEDs mounted to the substrate, and a heat sink for dissipating heat from the light emitting module. A support member may support the body at a predetermined tilt angle, and a connection member may be provided to the body for connecting the body to the support member to have a tilt adjust portion that enables to change a tilt angle of the body when the body is mounted to the support member.

The tilt adjust portion may include a plurality of seating portions in the connection member.

The seating portions adjacent to each other may form a step to have a predetermined height difference.

The seating portion may include a plurality of projections that each project inward from an inner circumference of the connection member.

The projections may have heights formed greater as the projections get closer to the body.

The support member may have one longitudinal end portion provided in a space between the inner circumference of the connection member and the projection, and/or between two adjacent projections.

One of the projections may prevent or stop the support member from entering into the body in an example where the support member is arranged in the connection member at a predetermined tilt angle.

The tilt adjust portion may include a screw that is movable in/out of the connection member so as to be in contact with the support member that passed through the connection member, and a stopper in the connection member for preventing the support member from entering into the body.

The connection member may include an upper housing having the tilt adjust portion, a middle cover fastened to the upper housing for supporting a region of the support member, and a lower housing mounted to the upper housing to surround the middle cover to form a predetermined space therein.

The upper housing may be formed as one unit with the body.

The support member may be supported on a free end portion of the upper housing at the time of the tilt adjustment.

The middle cover may have a plurality of projections from an inner circumference for increasing a contact area with the connection member.

The middle cover may be fastened to the upper housing with a screw in a state the middle cover is spaced from the upper housing by a predetermined distance.

The body may include a power supply unit that is electrically connected to the light emitting module. A cable connected to the power supply unit may be provided in the support member passed through the connection member.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a body including a substrate, a light emitting module with a light emitting diode (LED) mounted to the substrate, and a heat sink to dissipate heat from the light emitting module;

a support member to support the body at a plurality of different tilt positions relative to the support member, the support member including an end portion; and a connection member provided to the body to connect the body to the support member, the connection member including a first projection that extends to a first height and a second projection that extends to a second height, wherein the body is provided in a first tilt position relative to the support member when the first projection contacts the end portion of the support member without the second projection contacting the support member, and the body is provided in a second tilt position relative to the support member when the second projection contacts the end portion of the support member, wherein the support member includes a first surface to face an inner surface of the connection member, and a second surface, wherein when the body is in the first tilt position relative to the support member, the first projection contacts the second surface of the support member without the second projection contacting the support member, and when the body is in the second tilt position relative to the support member, the first projection contacts the first surface of the support member and the second projection contacts the second surface of the support member.

2. The lighting apparatus of claim 1, wherein the light emitting module to provide light in a first direction when the body is in the first tilt position relative to the support member, and the light emitting module to provide light in a second direction when the body is in the second tilt position relative to the support member.

3. The lighting apparatus of claim 1, wherein the first projection and the second projection each project inwardly from an inner surface of the connection member.

4. The lighting apparatus of claim 3, wherein the first projection is provided further away from the body than the second projection, and the second height of the second projection is greater than the first height of the first projection.

5. The lighting apparatus of claim 1, wherein the end portion of the support member is provided in a space of the connection member.

6. The lighting apparatus of claim 1, wherein the second projection prevents the support member from entering into the body when the support member is provided in the connection member at a predetermined tilt angle.

7. The lighting apparatus of claim 1, further comprising:

a screw movable in/out of the connection member so as to be in contact with the support member provided in the connection member, and a stopper in the connection member to prevent the support member from entering into the body.

8. The lighting apparatus of claim 1, wherein the connection member further includes:

an upper housing;

a middle cover coupled to the upper housing to support the support member; and a lower housing mounted to the upper housing to surround the middle cover and to form a predetermined space therein.

9. The lighting apparatus of claim 8, wherein the upper housing is formed with the body as one unit.

10. The lighting apparatus of claim 8, wherein a plurality of additional projections extend from an inner surface of the middle cover.

11. The lighting apparatus of claim 8, wherein the middle cover is fastened to the upper housing with a screw such that the middle cover is spaced from the upper housing by a predetermined distance.

12. The lighting apparatus of claim 1, further comprising:

a power supply unit to electrically connect to the light emitting module, and a cable electrically connected to the power supply unit by passing through the connection member.

13. A lighting apparatus comprising:

a body including a substrate, and a light emitting module mounted to the substrate, the light emitting module including a light emitting diode (LED);

a connection member attached to the body, the connection member including a first projection that extends from an inner surface to a first height and a second projection that extends from the inner surface to a second height; and a support member to couple to the connection member and support the body, the support member including an end portion, wherein the support member includes a first surface and a second surface, the first surface to face an inner surface of the connection member when the end portion extends into the connection member, wherein when the body is in a first tilt position relative to the support member, the second surface of the support member contacts the first projection without contacting the second projection, and when the body is in a second tilt position relative to the support member, the first surface of the support member contacts the first projection and the second surface of the support member contacts the second projection, wherein when the body is provided in the first tilt position relative to the support member, the light emitting module provides light in a first direction, and when the body is provided in a second tilt position relative to the support member, the light emitting module provides light in a second direction.

14. The lighting apparatus of claim 13, wherein the second projection prevents the support member from entering further into the body when the support member is provided in the connection member at a predetermined tilt angle.

15. The lighting apparatus of claim 13, further comprising:

a screw to be provided in the connection member so as to be in contact with the support member provided in the connection member, and a stopper in the connection member to prevent the support member from entering into the body.

16. The lighting apparatus of claim 13, wherein the connection member further includes:

an upper housing;

a middle cover coupled to the upper housing to support the support member; and a lower housing mounted to the upper housing to surround the middle cover and to form a predetermined space therein.

17. The lighting apparatus of claim 16, wherein the upper housing is formed with the body as one unit.

18. The lighting apparatus of claim 16, wherein a plurality of additional projections extend from an inner surface of the middle cover.

19. The lighting apparatus of claim 13, further comprising:

a power supply unit to electrically connect to the light emitting module; and a cable electrically connected to the power supply unit by passing through the connection member.

* * * * *